United States Patent [19]

Kakuda et al.

[11] Patent Number: 4,865,531

[45] Date of Patent: Sep. 12, 1989

[54] SCROLL COMPRESSOR WITH SUPER-CHARGING TUBE

[75] Inventors: Masayuki Kakuda; Etsuo Morishita, both of Amagasaki, Japan

[73] Assignee: Mitsubishi Denki Kabushiki Kaisha, Tokyo, Japan

[21] Appl. No.: 258,518

[22] Filed: Oct. 17, 1988

Related U.S. Application Data

[62] Division of Ser. No. 31,780, Mar. 30, 1987, Pat. No. 4,815,951.

[30] Foreign Application Priority Data

May 8, 1986 [JP] Japan ..... 61-105426

[51] Int. Cl.[4] ..... F04C 18/04; F04C 29/00

[52] U.S. Cl. ..... 418/55; 418/181

[58] Field of Search ..... 418/55 R, 55 A, 55 B, 418/55 C, 55 D, 55 E, 181, 270; 417/902; 123/52 M

[56] References Cited

U.S. PATENT DOCUMENTS

| | | | |
|---|---|---|---|
| 4,065,279 | 12/1977 | McCullough | 62/510 |
| 4,549,857 | 10/1985 | Kropiwnicki et al. | 417/902 |
| 4,673,339 | 6/1987 | Hayano et al. | 418/15 |
| 4,795,316 | 1/1989 | Kropiwnicki et al. | 417/902 |

FOREIGN PATENT DOCUMENTS

| | | |
|---|---|---|
| 57-70984 | 5/1982 | Japan . |
| 59-120796 | 7/1984 | Japan . |
| 60-206989 | 10/1985 | Japan . |

*Primary Examiner*—John J. Vrablik

*Attorney, Agent, or Firm*—Oblon, Spivak, McClelland, Maier & Neustadt

[57] ABSTRACT

In a scroll compressor for compressing gas by the relative orbital movement between first and second scrolls which combined with each other to form a compresson chamber therebetween and a super-charging tube is connected to an intake port formed in the first scroll. The volume of the gas to be compressed is controlled by changing the length of the super-discharging tube.

1 Claim, 8 Drawing Sheets

SCROLL COMPRESSOR WITH SUPER-CHARGING TUBE

This is a division of application Ser. No. 031,780, filed Mar. 30, 1987, U.S. Pat. No. 4,815,951.

BACKGROUND OF THE INVENTION

1. FIELD OF THE INVENTION

The present invention relates to a scroll compressor. More particularly, it relates to an improvement in a gas intaking means for introducing gas into a compression chamber.

2. DISCUSSION OF BACKGROUND

The principle of a scroll compressor will be briefly described with reference to FIG. 7.

In FIG. 7, a reference numeral 1 designates a stationary scroll, a numeral 2 designates an orbiting scroll, a numeral 3 designates a compression chamber formed between the stationary and orbiting scrolls combined together and a numeral 4 designates a discharge port formed in the stationary scroll 1.

The stationary and orbiting scrolls 1, 2 respectively have a wrap having the same shape in cross section in a state that they are combined with each other in 180° shifted condition. Each of the wraps has a shape constituted by an involute curve or the combination of arcs. The compression chamber 3 is formed by the combination of the wraps of the stationary and orbiting scrolls 1, 2. An intake port is formed at the outer periphery of the stationary scroll 1 to be communicated with the compression chamber 3.

In the operation of the scroll compressor, in which the orbiting scroll 2 is combined with the stationary scroll 1 which stands still in space, as shown in FIG. 7, the orbiting scroll 2 moves around the center of the stationary scroll 1 without movement of rotation, namely, a posture in angle of the orbiting scroll 2 is fixed. With the orbiting movement of the orbiting scroll 2 assuming successive movements as shown in FIGS. *7a, 7b, 7c* and *7 d,* the volume of the compression chamber 3 gradually decreases with he result that the gas sucked in the compression chamber 3 is compressed as the chamber 3 moves to the central portion of the stationary scroll 1, and the compressed gas is finally discharged through the discharge port 4.

FIG. 8 is a cross-sectional view showing the construction of the conventional scroll compressor disclosed in, for instance, Japanese Unexamined Patent Publication No. 206989/1985. The disclosed scroll compressor is the typical low pressure shell type scroll compressor.

In FIG. 8, a reference numeral 1 designates a stationary scroll, a numeral 2 an orbiting scroll, a numeral 3 a compression chamber, a numeral 4 a discharge port, a numeral 5 a discharge tube communicated with the discharge port 4, a numeral 6 an orbiting scroll shaft formed on the orbiting scroll 2, a numeral 7 a crank shaft, a numeral 8 an eccentric opening formed in the crank shaft 7, the orbiting scroll shaft 6 being fitted in the eccentric opening, a numeral 9 an eccentric bush provided in a space between the inner wall of the eccentric opening 8 and the outer surface of the orbiting scroll shaft 6, which constitutes a variable radius crank mechanism, a numeral 10 the rotor of an electric motor, a numeral 11 the stator of the motor, numerals 12 and 13 respectively designate housings which serve as bearings, a numeral 14 designates a primary bearing interposed between the crank shaft 7 and the housing 12 to reduce friction resulted therebetween, a numeral 15 a secondary bearing for supporting the crank shaft 7, a numeral 16 a thrust bearing which is in contact with the lower surface of the orbiting scroll 2 to bear a pressure produced in the compression chamber 3 and the dead weight of the orbiting scroll 2, a numeral 17 an Oldham coupling in a ring form in which a pair of projections are respectively formed in the upper and lower surfaces at their edge portions in the lines crossing at the right angle. The Oldham coupling is to prevent movement of rotation of the orbiting scroll 2 but to causes the orbiting movement. A reference numeral 18 designates a tip seal fitted in a groove formed in the end surface of the wrap of each of the stationary and orbiting scrolls 1, 2, a numeral 19 a first balancer formed integrally with the crank shaft 7, a numeral 20 a second balancer attached to the lower part of the rotor 10 of the motor, a numeral 21 a shell, a numeral 22 an intake tube, a numeral 23 a forming-prevention plate and a numeral 24 an oil pump attached to the lower end of the crank shaft 7.

The operation of the scroll compressor having the construction as above-mentioned will be described. When a current is supplied to the stator 11 of the motor, a torque is produced in the rotor 10 and the rotor is rotated with the crank shaft 7. The rotation of the crank shaft transmits the torque to the orbiting scroll shaft 6 which is fitted in the eccentric bush 9 eccentrically provided on the crank shaft 7. The orbiting scroll 2 undergoes the orbiting movement by the Oldham coupling 17 to thereby perform a compressing function as shown in FIG. 7. In the compressing function of the scrolls, leakage of the compressed gas from a first compression chamber at a high pressure to a second compression chamber at a low pressure in the radial direction of the scrolls is prevented because the tip seals are fitted in the grooves in the end surfaces of the wraps and seal gaps which may be produced between the bottom surface of the scrolls and the end surfaces in the axial direction of the shell.

Leakage of the compressed gas in the circumferential direction is prevented by the mutual contact of the side surfaces of the wraps of the stationary and orbiting scrolls 1, 2. The mutual contact can be effected by providing eccentricity to the eccentric bush 9 and by utilizing a centrifugal force resulted by the orbiting movement of the orbiting scroll 2.

The gas to be supplied into the shell 21 through the intake tube 22 cools the rotor 10 and the stator 11 of the electric motor, and thereafter the gas is introduced into a compression chamber 3 through the intake port. The gas is compressed in the chamber 3, and then, is discharged out of the scroll compressor through the discharge tube 5.

The conventional scroll compressor is insufficient to provide a high volumetric efficiency which can be obtained by introducing a greater volume of the gas to be compressed when the gas is sucked in the compression chamber 3 through the intake port. Further, it is necessary to change major parts such as the scrolls in order to change the capacity of the scroll compressor.

SUMMARY OF THE INVENTION

It is an object of the present invention to provide a scroll compressor having a high volumetric efficiency and facilitating the change of the capacity.

The foregoing and the other objects of the present invention have been attained by providing a scroll compressor which comprises a first scroll having a wrap, a second scroll having a wrap which is combined with the wrap of the first scroll to form a compression chamber therein, an orbital-movement-effecting means for effecting a relative orbital movement between the first and second scrolls during which the volume of the compression chamber gradually decreases, a container which contains the first and second scrolls and the orbital-movement-effecting means, and to which a gas to be compressed is supplied from the outside, a discharge tube for discharging the gas compressed in the compression chamber to the outside of the container, an intake port for supplying the gas in the container to the compression chamber, and a super-charging tube which has an end communicated with the intake port and the other end opened in the container to super-charge the gas to be compressed into the compression chamber through the super-charging tube.

The present invention is to further provide a scroll compressor which comprises a first scroll having a wrap, a second scroll having a wrap which is combined with the wrap of the first scroll to form a compression chamber therein, an orbital-movement-effecting means for effecting a relative orbital movement between the first and second scrolls during which the volume of the compression chamber gradually decreases, a container which contains the first and second scrolls and the orbital-movement-effecting means, and which supplies compressed gas to the outside, a discharge tube for discharging the gas compressed in the compression chamber into the container, an intake port for supplying the gas to be compressed into the compression chamber, and a super-charging tube which has an end communicated with the intake port and the other end opened outside the container to super-charge the gas to be compressed into the compression chamber through the super-charging tube.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
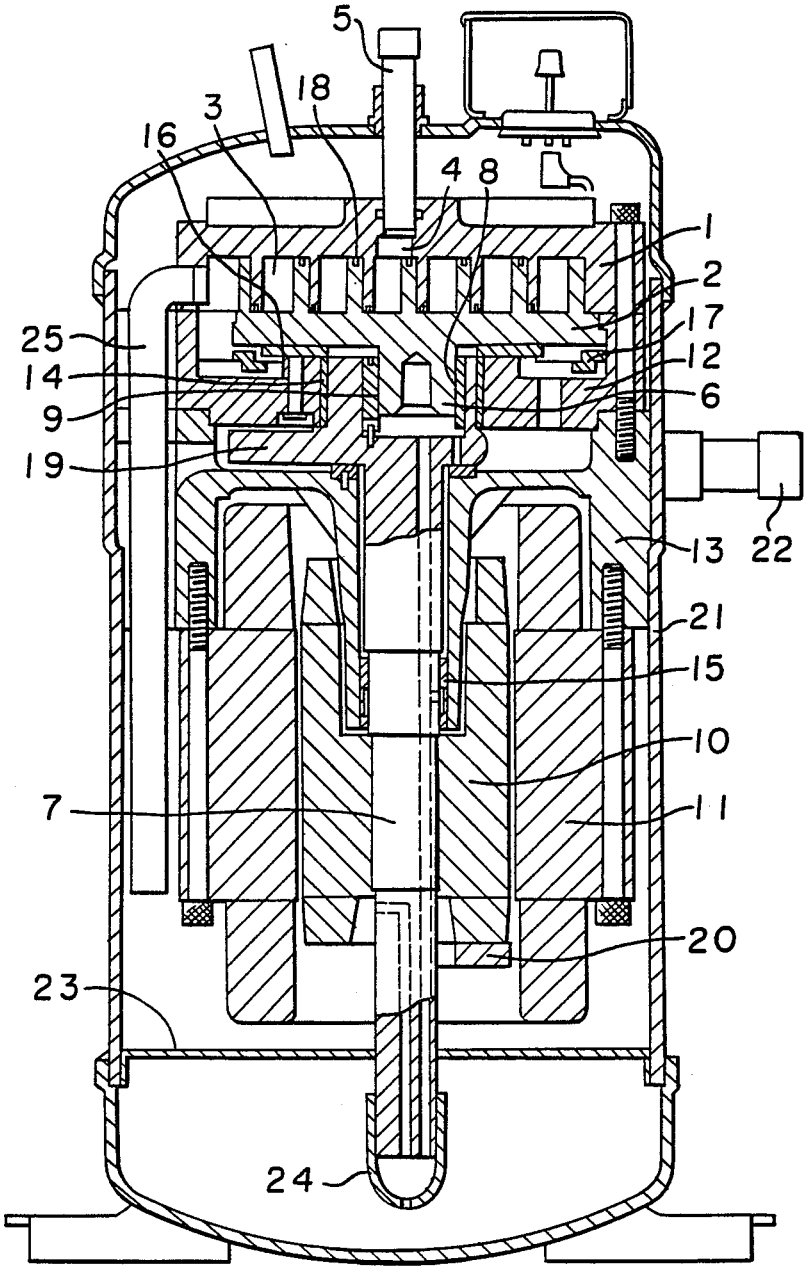
FIG. 1 is a longitudinal cross-sectional view of a first embodiment of the scroll compressor according to the present invention.

Referring now to the drawings, wherein like reference numerals designate the same or corresponding parts throughout the several views.

Figure 2:
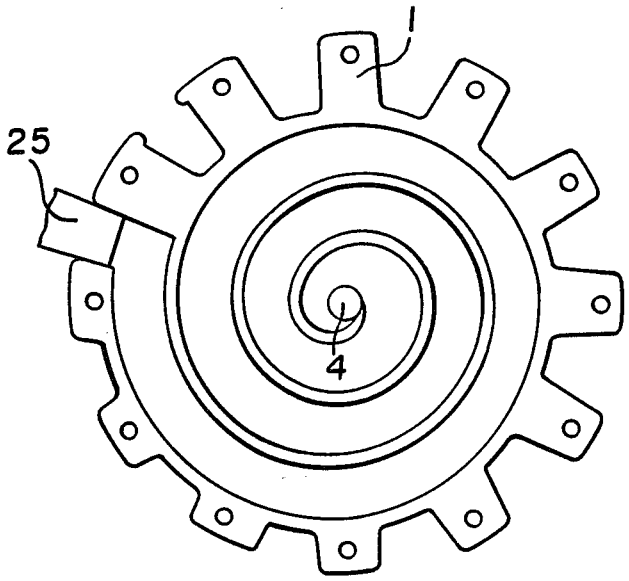
FIG. 2 is a plane view of a stationary scroll used for the scroll compressor of the present invention.
Figure 8:
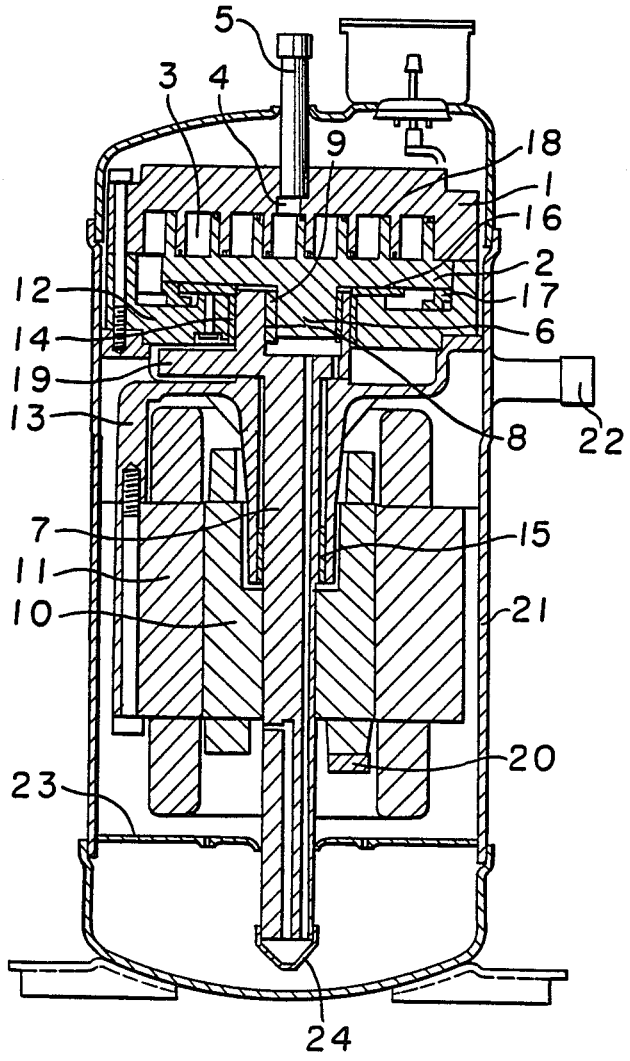
FIGURE 8 PRIOR ART
FIG. 8 is a longitudinal cross-sectional view of a conventional scroll compressor.

FIG. 1 is a longitudinal cross-sectional view of a first embodiment of the present invention, and FIG. 2 is a plane view of the stationary scroll used for the first embodiment. The construction of the first embodiment of the present invention is substantially same as that of the conventional scroll compressor as in FIG. 8 provided that a super-charging tube 25 is connected to the intake port.

In operations of the scroll compressor of the first embodiment. The gas in the compression chamber 3 is compressed by a relative orbiting movement between the stationary and orbiting scrolls 1, 2. A space formed at the outermost periphery of the scrolls, with which the super-charging tube 25 is communicated, gradually increases its volume from an angular position 0° of rotation, i.e. the beginning of the compressing function. The space is confined by the wraps during one revolution and becomes a compression chamber 3. The above-mentioned operations are repeated for each revolution. Accordingly, the flow of the gas to be compressed in the super-charging tube 25 is not constant, but flows with a periodic pulsation. The magnitude of the pulsation is primarily determined by the length of the super-charging tube 25. Namely, by suitably selecting the length of the tube, the volume of the gas to be sucked in the compression chamber 3 can be increased or decreased by utilizing the pulsated flow of the gas as shown in FIG. 3.

Figure 3:
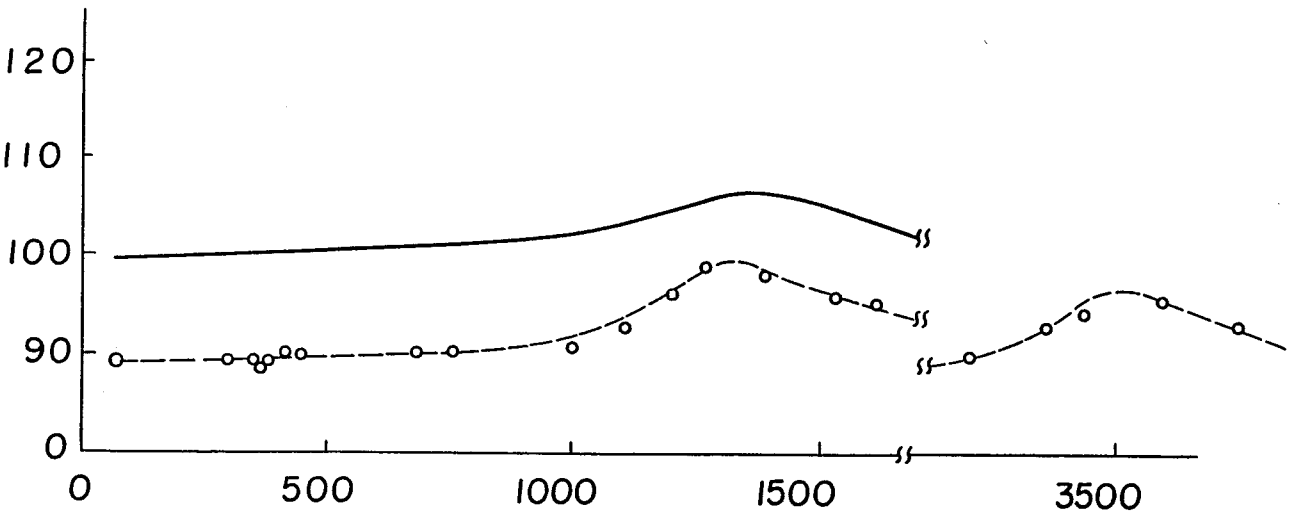
FIG. 3 is a characteristic diagram showing a relation of the length of a super-charging tube and a volumetric super-charging rate.

FIG. 3 is a characteristic diagram showing a relation of the length of the super-charging tube 3 to a volumetric super-charging rate (%), wherein the ordinate represents volumetric super-charging rate and the abscissa represents the length (mm) of the super-charging tube. The frequency of the orbiting movement of the orbiting scroll with respect to the stationary scroll was 3550 rpm or 59.17 Hz. In FIG. 3, a solid line represents numerical values obtained by an analysis (theoretical values) and a dotted line represents values obtained by experiments. The volumetric super-charging rate is a ratio of an increased volume of air to a normal volume of air to be sucked (where there is no pulsation).

As shown in FIG. 3, the length of the super-charging tube 3 at the time when the volumetric super-charging rate indicates the peak, is above 1350 mm, the peak of the theoretical value being identical with the experimental value. It is expected that the length is closely related to acoustic resonance in an air column having an end closed and the other end opened. When the distance of a sound wave moving forward during one oscillating movement of the oscillating scroll is four times as long as the length of the super-charging tube, there has taken place a resonance. The second resonance has been observed for the tube length which is three times (in an odd number) as long as the length at which the first resonance has occurred. The volumetric super-charging rate at the second resonance is smaller than that at the first resonance because friction increases as the length of the tube 25 is prolonged. Accordingly, by connecting the super-charging tube attached at its one end to the intake port, the other end being opened in the shell 21, the volumetric super-charging rate, i.e. the capacity of the scroll compressor can be easily changed within a given range by varying the length of the tube 25.

As shown in FIG. 3, the volumetric super-charging rate becomes the maximum when the length L of the super-charging tube satisfies the following equation (1) (i.e. L=1350 mm).

$$L=n\times(\tfrac{1}{4}\times a\div f)\ldots \quad (1)$$

where n is an odd number, a is the sonic speed and f is a frequency of a relative orbital movement between the first and the second scrolls.

Thus, the scroll compressor having a high volumetric efficiency can be obtained.

FIG. 2 is a plane view of the stationary scroll of the scroll compressor shown in FIG. 1. The gas to be compressed in the compression chamber 3 is entirely introduced in the chamber 3 through the super-charging tube 25. The area of the groove of the stationary scroll is broadened over about half a circle in the outer circumferential wall surface of the stationary scroll 1 so that the gas easily flows to the opposite side of the chamber.

Figure 4:
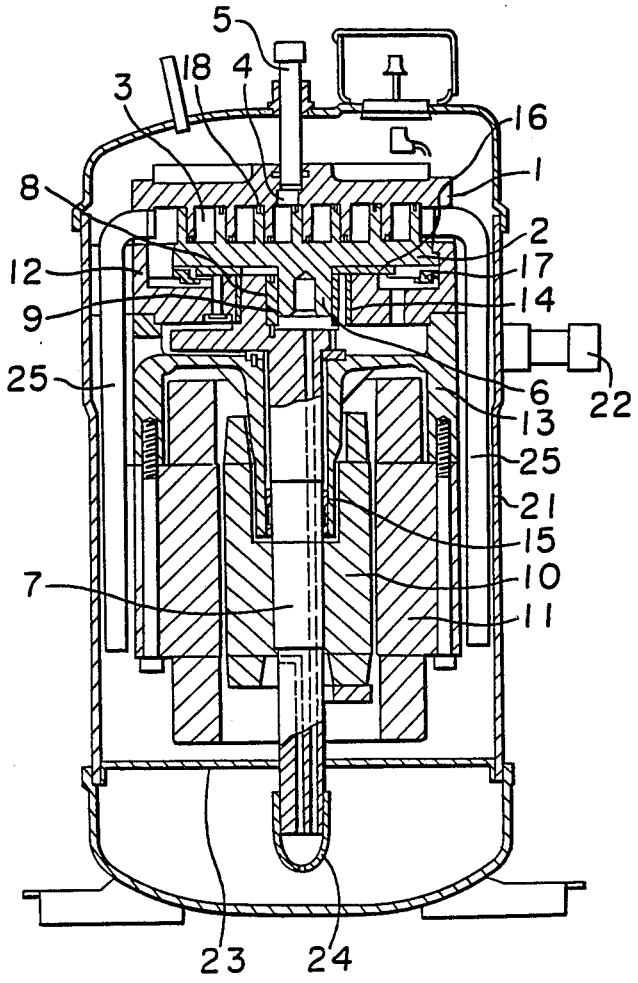
FIG. 4 is a longitudinal cross-sectional view of another embodiment of the scroll compressor according to the present invention.
Figure 5:
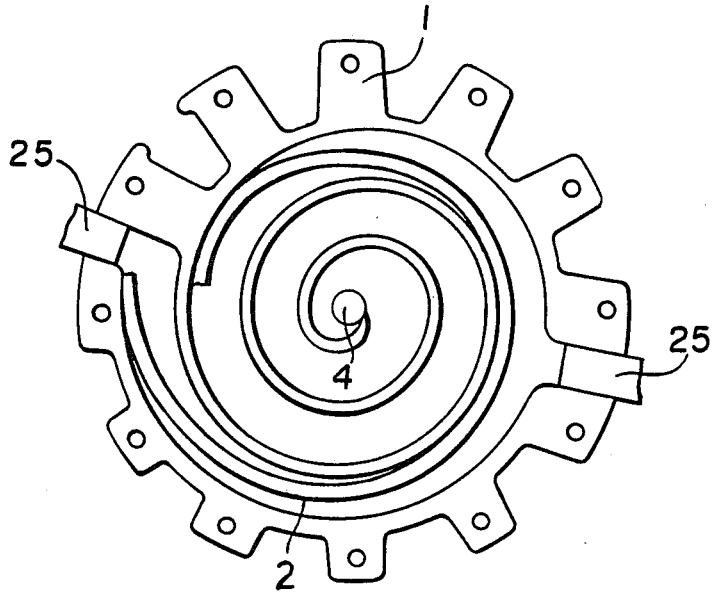
FIG. 5 is a plane view showing a stationary scroll used for the embodiment show in FIG. 4.

FIG. 4 shows another embodiment of the present invention. Two super-charging tubes 25 may be provided at symmetric positions with respect to the center of the stationary scroll. In this case, two compression chambers 3 have the same configuration and are at symmetric positions. FIG. 5 is a plane view of the stationary scroll in which two super-charging tubes are respectively connected to the intake ports at the diametrically opposing positions. The positions are so determined that the outermost portion of the wrap of the orbiting scroll comes to contact with the wrap of the stationary scroll at the completion of a sucking operation (i.e. a compression chamber is formed at the outer circumferential portion). With the arrangement, an unbalanced condition between the two compression chambers 3 at the symmetric position is avoidable.

Figure 6:
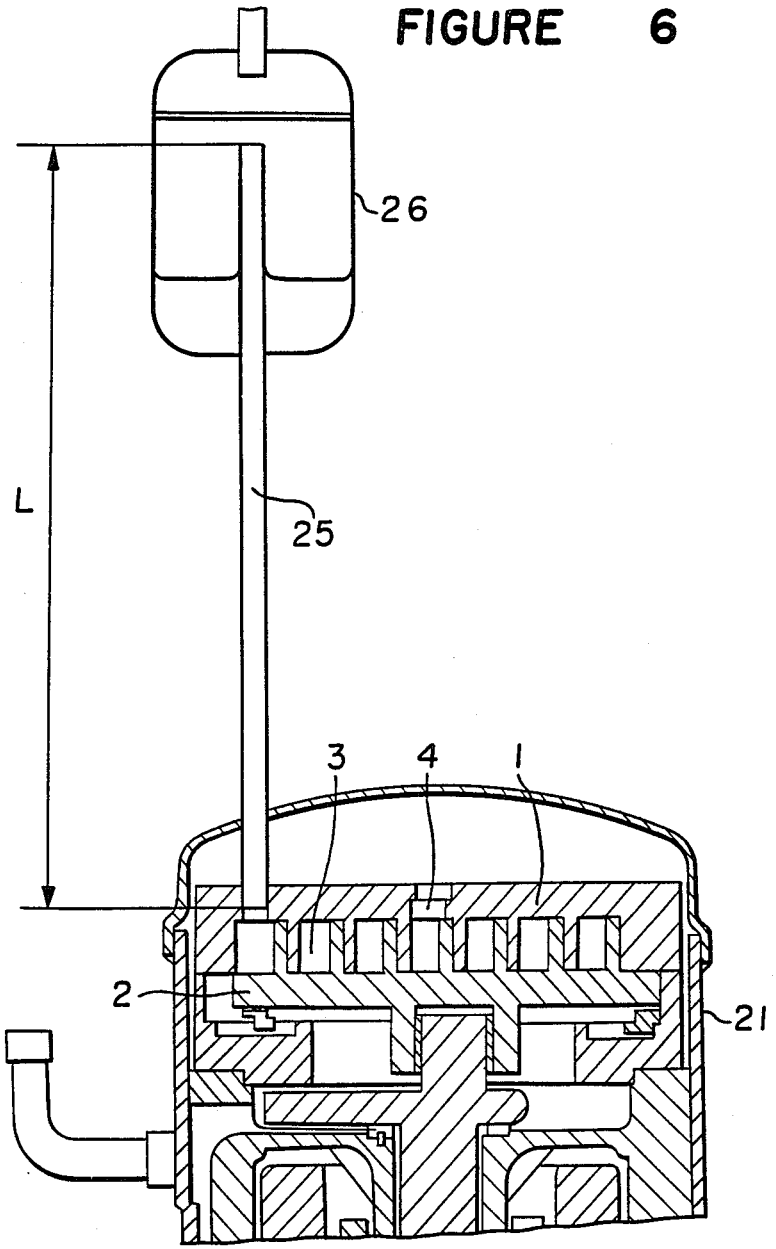
FIG. 6 is a longitudinal cross-sectional view partly broken of a still another embodiment of the scroll compressor according to the present invention.
Figure 7:
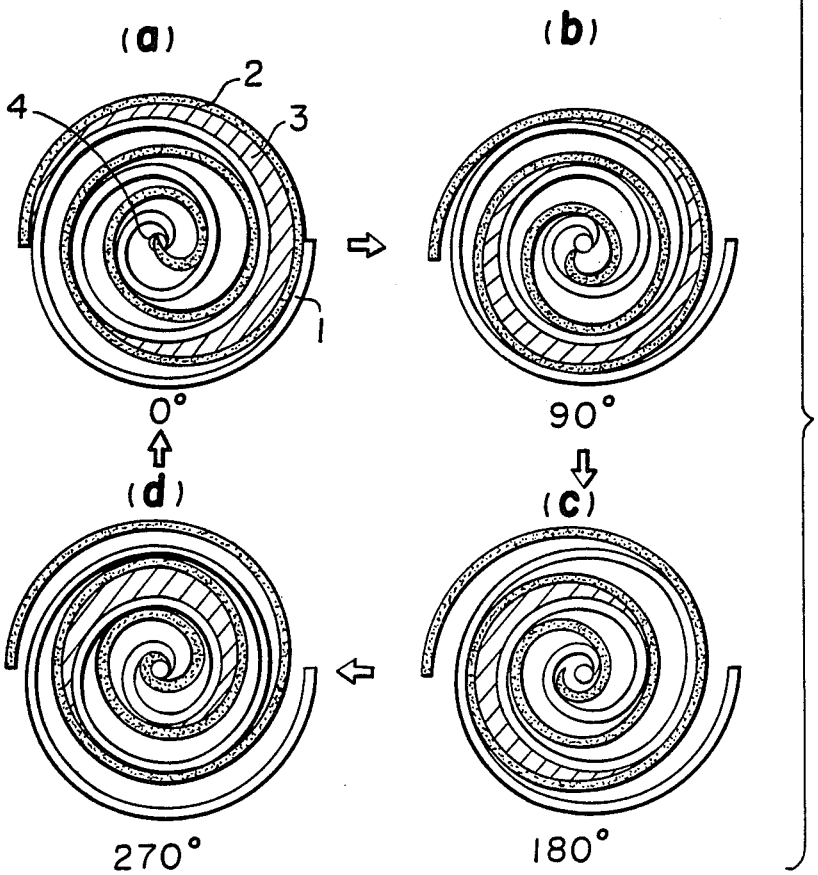
FIGURE 7 PRIOR ART
FIGS. 7(*a*) to 7(*d* ) are diagrams showing the principle of the typical scroll compressor.

FIG. 6 is a longitudinal cross-sectional view showing a still another embodiment of the present invention. The scroll compressor shown in FIG. 6 is a so-called high pressure shell type scroll compressor. The construction of the compressor is substantially same as that in FIG. 1 provided that a super-charging tube 25 is extended from the compression chamber 3 to the outside of the shell, and the other end of the tube 25 is connected to an intake muffler 26. The gas compressed in the compression chamber 3 is discharged in the shell 21 through the discharge port 4, and then, the discharged gas in the shell 21 is supplied to the outside of the scroll compressor.

In the high pressure shell type scroll compressor, the volumetric efficiency can be improved by determination of the length L of the super-charging tube to satisfy the equation (1), as is the low pressure shell type scroll compressor.

As described above, in accordance with the present invention, a scroll compressor having a high volumetric efficiency and capable of easy changing of the capacity can be obtained.

Obviously, numerous modifications and variations of the present invention are possible in light of the above teachings. It is therefore to be understood that within the scope of the appended claims, the invention may be practiced otherwise than as specifically described herein.

What is claimed is:

1. A scroll compressor which comprises:

a first scroll having a wrap, a second scroll having a wrap which is combined with the wrap of said first scroll to form a compression chamber therein, an orbital-movement-effecting means for effecting a relative orbital movement between said first and second scrolls during which the volume of said compression chamber gradually decreases, a container which contains said first and second scrolls and said orbital-movement-effecting means, and which supplies compressed gas to the outside, a discharge tube for discharging the gas compressed in said compression chamber into said container, an intake port for supplying the gas to be compressed into said compression chamber, and a super-charging tube which has an end communicated with said intake port and the other end opened outside said container to super-charge the gas to be compressed into said compression chamber through said super-charging tube, wherein the length of said super-charging tube is determined to satisfy the following equation:

$$L=n\times(\tfrac{1}{4}\times a\div f)\ldots \quad (1)$$

wherein n is an odd number, a is the sonic speed and f is the frequency of a relative orbital movement between the first and second scrolls.

* * * * *